United States Patent [19]

Kameyama et al.

[11] 4,142,432

[45] Mar. 6, 1979

[54] ELECTRONIC MUSICAL INSTRUMENT

[75] Inventors: Seiji Kameyama; Hironori Watanabe, both of Hamamatsu, Japan

[73] Assignee: Kabushiki Kaisha Kawai Gakki Seisakusho, Hamamatsu, Japan

[21] Appl. No.: 773,303

[22] Filed: Mar. 1, 1977

[30] Foreign Application Priority Data

Apr. 28, 1976 [JP] Japan ..... 51/49272

[51] Int. Cl.[2] ..... G10H 1/02; G10H 5/02

[52] U.S. Cl. ..... 84/1.01; 84/1.03; 84/1.13; 84/1.22; 84/1.24; 84/1.26; 364/419; 364/718

[58] Field of Search ..... 84/1.01, 1.03, 1.13, 84/1.22, 1.24, 1.26; 364/419, 718

[56] References Cited

U.S. PATENT DOCUMENTS 3,992,970 11/1976 Chibana et al. ..... 84/1.03 X

*Primary Examiner*—Stanley J. Witkowski

[57] ABSTRACT

This invention relates to an electronic musical instrument which comprises a waveshape computation cycle, a waveshape transmission cycle and an envelope load output. In the waveshape computation cycle, a musical waveshape is obtained in the form of the accumulation of the products of the nth powers of the fundamental frequency of a cosine wave and coefficients $A_n$ indicating harmonic components of a musical note in certain relationship.

8 Claims, 23 Drawing Figures

FIG. 2B

1. MAIN CLOCK GENERATOR
3. COSINE WAVE READ PULSE GENERATOR
4. COSINE WAVE MEMORY READ COUNTER
5. COSINE WAVE MEMORY
6. DATA SWITCHING CIRCUIT I - 6
7. DATA SWITCHING CIRCUIT II - 7
8. LATCH PULSE GENERATOR
9. LATCH CIRCUIT I - 9
10. MULTIPLIER
11. $A_n$ COEFFICIENT READ PULSE GENERATOR
12. $A_n$ COEFFICIENT READ COUNTER
13. $A_n$ COEFFICIENT MEMORY
14. $A_n$ COEFFICIENT ADDER
15 $A_n$ COEFFICIENT MULTIPLIER
17. ACCUMULATION CONTROL PULSE GENERATOR
18. ACCUMULATOR
19. WRITE ADDRESS COUNTER
20. READ ADDRESS COUNTER
21. COMPOSITE WAVESHAPE MEMORY CONTROL CIRCUIT
22. COMPOSITE WAVESHAPE MEMORY I
23. COMPOSITE WAVESHAPE TRANSMISSION CLOCK GENERATOR ft

F I G. 3B

31. COMPOSITE WAVESHAPE MEMORY II-A

32. AND GATE (FINAL ADDRESS)

33. WRITE COUNTER

35. COMPOSITE WAVESHAPE MEMORY II-B

36. READ-WRITE COUNTER

39. COMPOSITE WAVESHAPE COMPLEMENTING CONTROL CIRCUIT

40. WAVESHAPE COMPLEMENTING MULTIPLIER A

41. WAVESHAPE COMPLEMENTING MULTIPLIER B

42. WAVESHAPE COMPLEMENTING CONTROL CIRCUIT

50. ADDER

ELECTRONIC MUSICAL INSTRUMENT

BACKGROUND OF THE INVENTION

1. Field of the Invention

This invention relates to an electronic musical instrument, and more particularly to an electronic musical instrument for synthesizing musical notes by summing the products of multiplication of the nth powers of the fundamental frequency of a cosine wave and its coefficients $A_n$.

2. Description of the Prior Art

Electronic musical instruments employing a digital system are indicated in U.S. Pat. No. 3,515,792 entitled "Digital Organ" and U.S. Pat. No. 3,809,786 entitled "Computor Organ". In the organ described in U.S. Pat. No. 3,515,792, the musical waveform required is sampled for one period, quantized and stored in a read-only memory. The stored waveform is repetitively read out by one or more clocks corresponding to the keyboard and multiplied or divided by an envelope waveshape stored in the read-only memory. In the organ set forth in U.S. Pat. No. 3,809,786, a discrete Fourier algorithm is implemented to compute each amplitude from a stored set of harmonic coefficients $C_n$ and a selected frequency number R. More in detail, the computations occur at regular time intervals independently of the waveshape period. In the waveshape computations carried out at regular time intervals, waveshape sample points qR (q=1, 2, 3, . . . ) are calculated by a note interval adder from the frequency number R corresponding to a key. For each sample point, W harmonics are read out by a harmonic interval adder and multiplied by harmonic coefficients $C_n$ characterizing the musical waveshape, by which $C_n$ ($\pi nqR/W$), (n=1, 2, 3, . . . W) is calculated. During the above operation, attack, decay, release and other amplitude modulation effects are obtained by scaling the harmonic coefficients. The computations are all in real-time, so that the musical waveshape is obtained in real time.

While the conventional organs are quite useful they have some limitations. For example, in the organ of U.S. Pat. No. 3,515,792, the musical waveshape is stored in the read-only memory. On account of this, the stored content cannot be readily changed. In order to obtain a plurality of waveshapes, it is necessary to provide a number of memories respectively corresponding to the desired musical waveshapes. The organ of U.S. Pat. No. 3,809,786 is capable of synthesizing desired musical waveshapes and has some other advantages but, in this computer organ, computations are on real-time basis, so that a very high clock frequency is required. For example, in the case of generating a 32nd harmonic with respect to a sound having a scale frequency of up to 20.9KHz ($C_7$), it is necessary to employ in the computer organ, for a single channel 4.29MHz. In a polyphonic tone synthesizing system in which the sound is time-divided by the employment of a single computation channel, the clock frequency is as high as 51.43MHz. As a result of this, integration of this circuit is difficult and inadvisable from the economical point of view.

SUMMARY OF THE INVENTION

This invention is to overcome the abovesaid limitations of the prior art.

One object of this invention is to provide an electronic musical instrument which is capable of synthesizing polyphonic musical notes electronically.

Another object of this invention is to provide an electronic musical instrument which comprises a waveshape computation cycle, a waveshape transmission cycle and an envelope load output. In the waveshape computation cycle, a musical waveshape is obtained in the form of the accumulation of the products of the nth powers of the fundamental frequency of a cosine wave and coefficients $A_n$ indicating harmonic components of a musical note in certain relationships.

Another object of this invention is to provide an electronic musical instrument which is adapted to be capable of waveshape correction in the waveshape transmission cycle.

DESCRIPTION OF THE PREFERRED EMBODIMENTS

Figure 1:
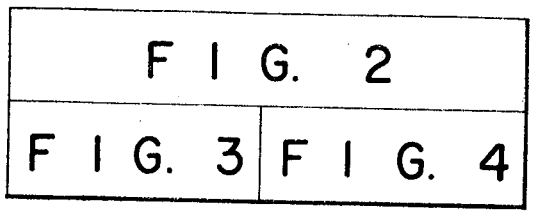
FIG. 1 is a diagram showing the relative arrangement of FIGS. 2A, 3A, and 4.

It has heretofore been known that the frequency component of a musical waveshape can be expressed mathematically in terms of the sum of its harmonic components by the Fourier series. Since the human ear is insensitive to phase, the musical waveshape can be represented by the Fourier series having only sin or only cos terms.

A musical waveshape f(t), expressed using the cos terms, is as follows:

$$f(t) = \sum_{n=1}^{N} a_n \cdot \cos n\omega t \quad (1)$$

where $a_n$ is a harmonic coefficient, n the harmonic order, $\omega$ angular acceleration and N the highest harmonic order.

By utilizing the following conversion of a cosine wave of trigonometric function:

$$\cos 2\theta = 2\cos^2\theta - 1 \ldots \quad (2)$$

cosine waves of the respective orders can be transformed as follows: (harmonics to the eighth one being exemplified)

$$\cos\theta = \cos\theta$$
$$\cos 2\theta = 2\cos^2\theta - 1$$
$$\cos 3\theta = 4\cos^3\theta - 3\cos\theta$$
$$\cos 4\theta = 8\cos^4\theta - 8\cos^2\theta + 1$$
$$\cos 5\theta = 16\cos^5\theta - 20\cos^3\theta + 5\cos\theta$$
$$\cos 6\theta = 32\cos^6\theta - 48\cos^4\theta + 18\cos^2\theta - 1$$
$$\cos 7\theta = 64\cos^7\theta - 112\cos^5\theta + 56\cos^3\theta + 56\cos^3\theta - 7\cos\theta$$
$$\cos 8\theta = 128\cos^8\theta - 128\cos^6\theta + 144\cos^4\theta - 16\cos^2\theta + 1$$

In the transformation utilizing the above theorem of the cosine wave, on the left hand sides, the cosine waves of the respective orders are multiplied by the harmonic coefficient and, on the right hand sides, the cosine waves of the same power are respectively added and their coefficient is taken as $A_n$. By adding the left hand sides respectively, it follows that $$\text{Left hand side} = \sum_{n=1}^{N} a_n \cdot \cos n\omega t \quad (4)$$

$$\text{Right hand side} = \sum_{n=0}^{N} A_n \cdot \cos^n \omega t \quad (5)$$

In this case, however, the harmonic coefficient $a_n$ of the cosine wave and the coefficient $A_n$ of the nth power of the cosine wave bear the following relationships. By way of example, the case of n=8 is shown.

$$A_0 = -a_2 + a_4 - a_6 + a_8$$
$$A_1 = a_1 - 3a_3 + 5a_2 - 7a_7$$
$$A_2 = 2a_2 - 8a_4 + 18a_6 - 32a_8$$
$$A_3 = 4a_3 - 20a_5 + 56a_7 \ldots \quad (6)$$
$$A_4 = 8a_4 - 48a_6 + 160a_8$$
$$A_5 = 32a_6 - 256a_8$$
$$A_7 = 64a_7$$
$$A_8 = 128a_8$$

Thus, by utilizing the abovesaid conversion, the musical waveshape can be represented in the form of the sum of the multiplication products of the nth power of the fundamental of the cosine waves by the coefficient $A_n$, that is, in the form of the equation (5). This invention utilizes such a relationship of the equation (5) for the formation of a musical waveshape. With reference to the drawings, this invention will hereinafter be described in detail referring to Table I.

Table 1

| Frame | t | Outputs from the cosine wave memory | Inputs a to the multiplier (Outputs from the data switching circuit I-6) | Inputs b to the multiplier (Outputs from the latch circuit I-9) | Outputs from the multiplier 10 | Outputs from the $A_n$ coefficient memory 13 | Outputs from the $A_n$ coefficient multiplier 15 | Accumulator 18 |
|---|---|---|---|---|---|---|---|---|
| | 1 | $\cos\frac{0\pi}{W} = 1$ | 1 | 1 | 1 | $A_0$ | $A_0$ | $A_0$ |
| | 2 | $\cos\frac{0\pi}{W} = 1$ | $\cos\frac{0\pi}{W} = 1$ | 1 | 1 | $A_1$ | $A_1$ | $A_0 + A_1$ |
| P = 0 | 3 | $\cos\frac{0\pi}{W} = 1$ | $\cos\frac{0\pi}{W}$ | 1 | 1 | $A_2$ | $A_2$ | $A_0 + A_1 + A_2$ |
| | 4 | $\cos\frac{0\pi}{W} = 1$ | $\cos\frac{0\pi}{W}$ | 1 | 1 | $A_3$ | $A_3$ | $A_0 + A_1 + A_2 + A_3$ |
| | ⋮ | ⋮ | ⋮ | ⋮ | ⋮ | ⋮ | ⋮ | ⋮ |
| | i | $\cos\frac{0\pi}{W} = 1$ | $\cos\frac{0\pi}{W}$ | 1 | 1 | $A_{i-1}$ | $A_{i-1}$ | $A_0 + A_1 + A_2 + A_3 + \ldots + A_{i-1}$ |
| | ⋮ | ⋮ | ⋮ | ⋮ | ⋮ | ⋮ | ⋮ | ⋮ |
| | W−1 | $\cos\frac{0\pi}{W} = 1$ | $\cos\frac{0\pi}{W}$ | 1 | 1 | $A_w$ | $A_w$ | $A_0 + A_1 + A_2 + A_3 + \ldots + A_{i-1} + \ldots + A_w$ |
| | 1 | $\cos\frac{\pi}{W}$ | 1 | 1 | 1 | $A_0$ | $A_0$ | $A_0$ |
| | 2 | $\cos\frac{\pi}{W}$ | $\cos\frac{\pi}{W}$ | 1 | $\cos\frac{\pi}{W}$ | $A_1$ | $A_1 \cdot \cos\frac{\pi}{W}$ | $A_0 + A_1 \cdot \cos\frac{\pi}{W}$ |
| P = 1 | 3 | $\cos\frac{\pi}{W}$ | $\cos\frac{\pi}{W}$ | $\cos^1\frac{\pi}{W}$ | $\cos^2\frac{\pi}{W}$ | $A_2$ | $A_2 \cdot \cos^2\frac{\pi}{W}$ | $A_0 + A_1 \cdot \cos\frac{\pi}{W} + A_2 \cdot \cos^2\frac{\pi}{W}$ |
| | 4 | $\cos\frac{\pi}{W}$ | $\cos\frac{\pi}{W}$ | $\cos^2\frac{\pi}{W}$ | $\cos^3\frac{\pi}{W}$ | $A_3$ | $A_3 \cdot \cos^3\frac{\pi}{W}$ | $A_0 + A_1 \cdot \cos\frac{\pi}{W} + A_2 \cdot \cos^2\frac{\pi}{W}\ A_3 \cdot \cos^3\frac{\pi}{W}$ |
| | ⋮ | ⋮ | ⋮ | ⋮ | ⋮ | ⋮ | ⋮ | ⋮ |
| | i | $\cos\frac{\pi}{W}$ | $\cos\frac{\pi}{W}$ | $\cos^{i-2}\frac{\pi}{W}$ | $\cos^{i-1}\frac{\pi}{W}$ | $A_{i-1}$ | $A_{i-1} \cdot \cos^{i-1}\frac{\pi}{W}$ | $A_0 + A_1 \cdot \cos\frac{\pi}{W} + A_2 \cdot \cos^2\frac{\pi}{W} + A_3 \cdot \cos^3\frac{\pi}{W} + \ldots + A_{i-1}\cos^{i-1}\frac{\pi}{W}$ |
| | ⋮ | ⋮ | ⋮ | ⋮ | ⋮ | ⋮ | ⋮ | ⋮ |
| | W+1 | $\cos\frac{\pi}{W}$ | $\cos\frac{\pi}{W}$ | $\cos^{w-1}\frac{\pi}{W}$ | $\cos^{w}\frac{\pi}{W}$ | $A_w$ | $A_w \cdot \cos^{w}\frac{\pi}{W}$ | $A_0 + A_1 \cdot \cos\frac{\pi}{W} + A_2 \cdot \cos^2\frac{\pi}{W} + A_3 \cdot \cos^3\frac{\pi}{W} + \ldots + A_{i-1} \cdot \cos^{i-1}\frac{\pi}{W} + \ldots + A_w \cdot \cos^{w}\frac{\pi}{W}$ |
| | ⋮ | | | | | | | |
| | 1 | $\cos\frac{K\pi}{W}$ | 1 | 1 | 1 | $A_0$ | $A_0 \cdot 1$ | $A_0$ |
| | 2 | $\cos\frac{K\pi}{W}$ | $\cos\frac{K\pi}{W}$ | 1 | $\cos\frac{K\pi}{W}$ | $A_1$ | $A_1 \cdot \cos\frac{K\pi}{W}$ | $A_0 + A_1 \cdot \cos\frac{K\pi}{W}$ |
| P = K | 3 | $\cos\frac{K\pi}{W}$ | $\cos\frac{K\pi}{W}$ | $\cos\frac{K\pi}{W}$ | $\cos^2\frac{K\pi}{W}$ | $A_2$ | $A_2 \cdot \cos^2\frac{K\pi}{W}$ | $A_0 + A_1 \cdot \cos\frac{K\pi}{W} + A_2 \cdot \cos^2\frac{K\pi}{W}$ |
| | 4 | $\cos\frac{K\pi}{W}$ | $\cos\frac{K\pi}{W}$ | $\cos^2\frac{K\pi}{W}$ | $\cos^3\frac{K\pi}{W}$ | $A_3$ | $A_3 \cdot \cos^3\frac{K\pi}{W}$ | $A_0 + A_1 \cdot \cos\frac{K\pi}{W} + A_2 \cdot \cos^2\frac{K\pi}{W} + A_3 \cdot \cos^3\frac{K\pi}{W}$ |

Table 1-continued

| Frame | t | Outputs from the cosine wave memory | Inputs a to the multiplier (Outputs from the data switching circuit I-6) | Inputs b to the multiplier (Outputs from the latch circuit I-9) | Outputs from the multiplier 10 | Outputs from the $A_n$ coefficient memory 13 | Outputs from the $A_n$ coefficient multiplier 15 | Accumulator 18 |
|---|---|---|---|---|---|---|---|---|
| | ⋮ | ⋮ | ⋮ | ⋮ | ⋮ | ⋮ | ⋮ | ⋮ |
| | i | $\cos\frac{K\pi}{W}$ | $\cos\frac{K\pi}{W}$ | $\cos^{i-2}\frac{K\pi}{W}$ | $\cos^{i-1}\frac{K\pi}{W}$ | $A_{i-1}$ | $A_{i-1}\cdot\cos^{i-1}\frac{K\pi}{W}$ | $A_0 + A_1\cdot\cos\frac{K\pi}{W} + A_2\cdot\cos^2\frac{K\pi}{W} + A_3\cdot\cos^3\frac{K\pi}{W} + \ldots + A_{i-1}\cdot\cos^{i-1}\frac{K\pi}{W}$ |
| | ⋮ | ⋮ | ⋮ | ⋮ | ⋮ | ⋮ | ⋮ | ⋮ |
| | W+1 | $\cos\frac{K\pi}{W}$ | $\cos\frac{K\pi}{W}$ | $\cos^{w-1}\frac{K\pi}{W}$ | $\cos^{w}\frac{K\pi}{W}$ | $A_w$ | $A_w\cdot\cos^{w}\frac{K\pi}{W}$ | $A_0 + A_1\cdot\cos\frac{K\pi}{W} + A_2\cdot\cos^2\frac{K\pi}{W} + A_3\cdot\cos^3\frac{K\pi}{W} + \ldots + A_{i-1}\cdot\cos^{i-1}\frac{K\pi}{W} + \ldots + A_w\cdot\cos^{w}\frac{K\pi}{W}$ |

FIG. 1 is a diagram of the relative arrangement of FIGS. 2A, 2B, 3A, 3B and 4, showing the construction of this invention.

Figure 4:
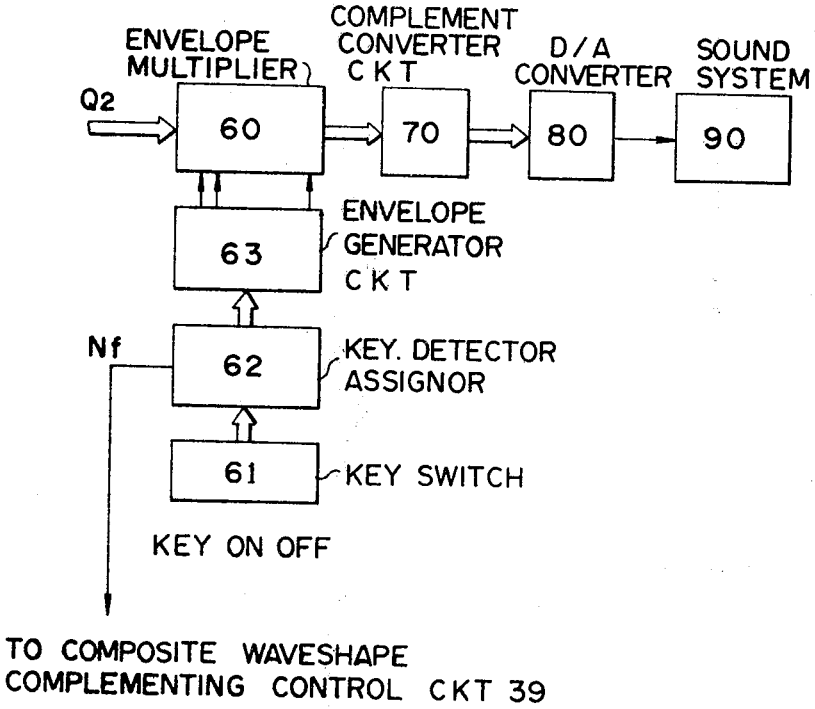
FIG. 4 shows an envelope load output.
Figure 2A:
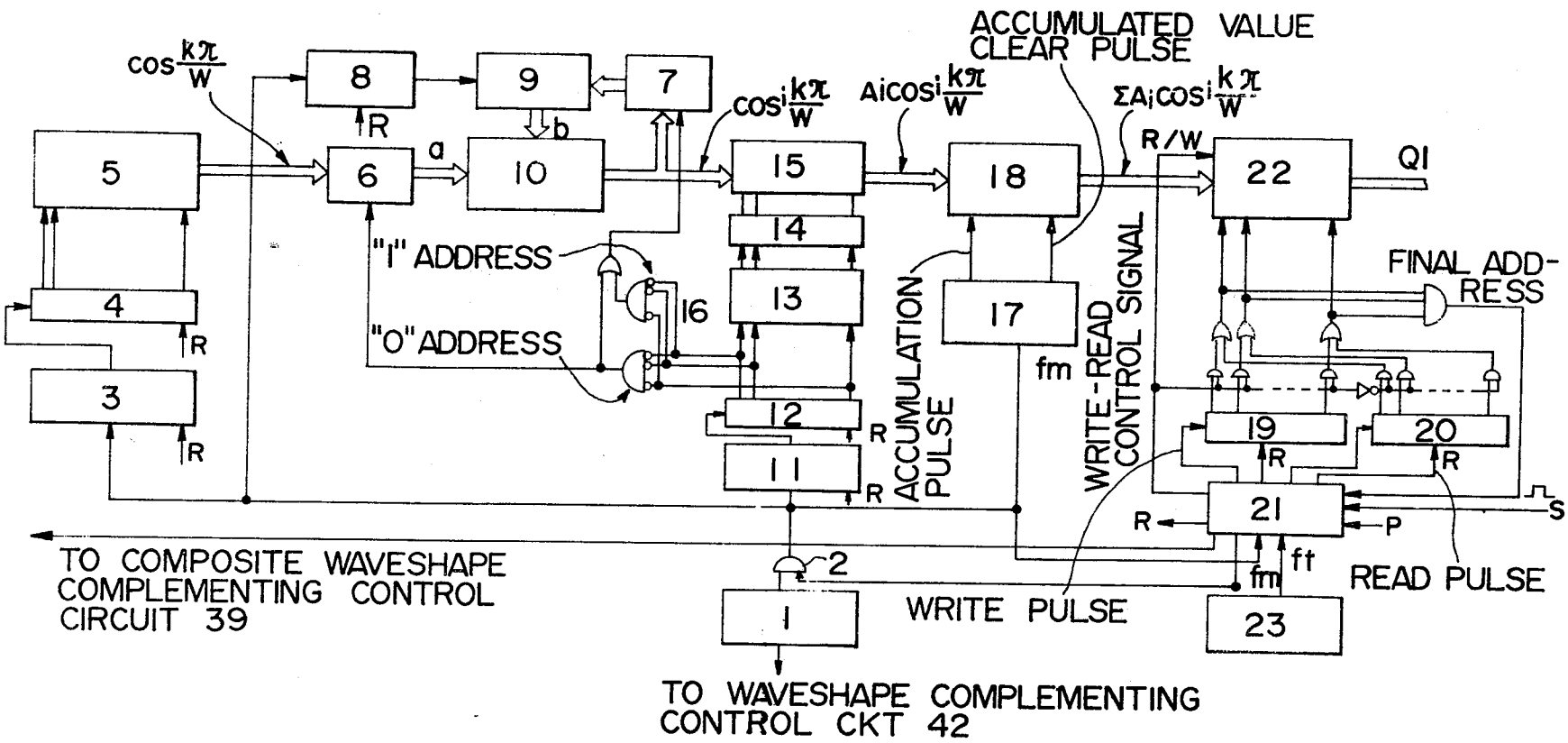
FIG. 2A is a block diagram showing a computation cycle and FIG. 2B designates the legends for the boxes of 2A.
Figure 3A:
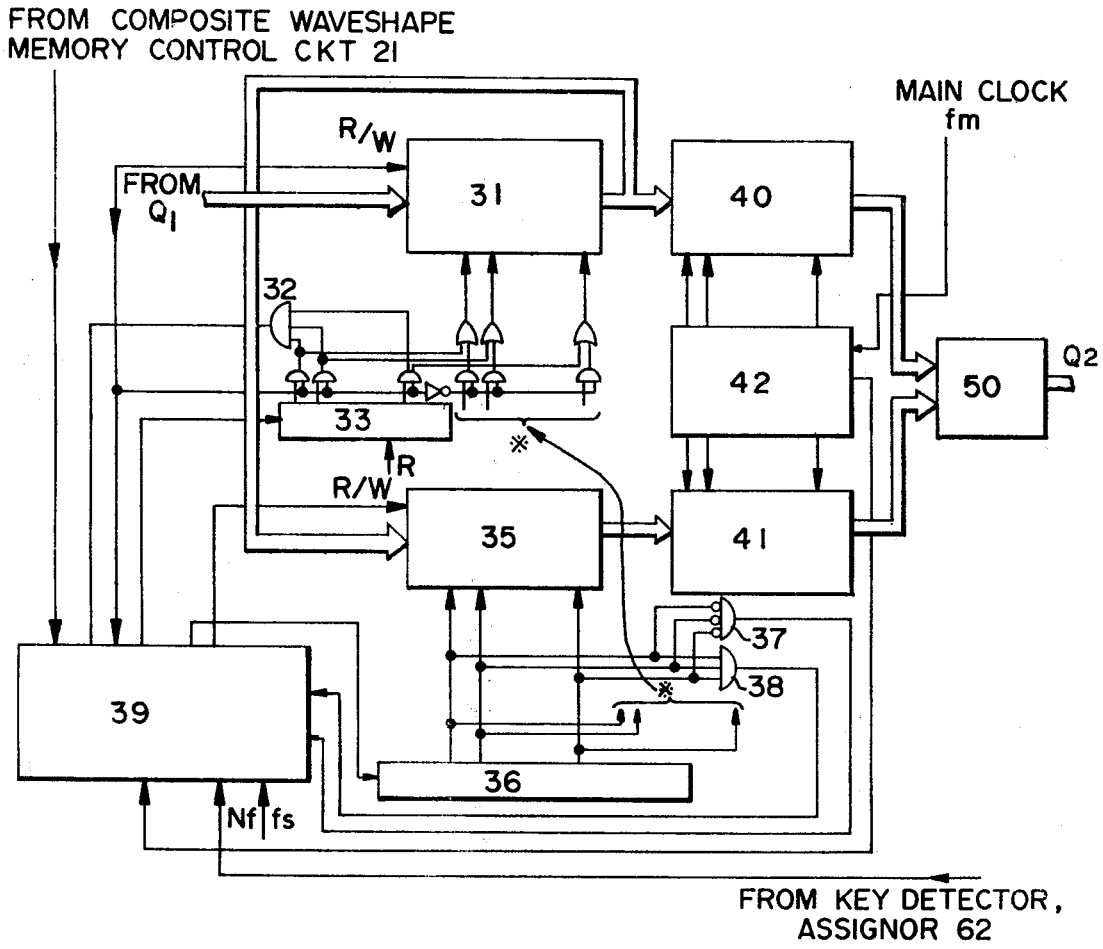
FIG. 3A is a block diagram showing a transmission cycle and FIG. 3B designates the legends for the boxes of 3A.

FIGS. 2A and 2B show a computation cycle, FIGS. 3A and 3B a transmission cycle and FIG. 4 an envelope load output. Based on FIGS. 1, 2A, 2B, 3A, 3B and 4 the outline of this invention will be described. In the computation cycle depicted in FIGS. 2A and 2B, reference numeral 1 indicates a main clock generator; 2 designates a gate circuit; 3 indentifies a cosine wave read pulse generator; 4 denotes a cosine wave memory read counter; and 5 represents a cosine wave memory. The cosine wave memory 5 stores a sampled value y(W,K) of the fundamental of a cosine wave. That is, $$y(W,K) = \cos(K\pi/W) \ldots \quad (7)$$

where W is the highest harmonic order, $N \geqq 2W$, K is sample points (0,1, 2, . . . N−1) and N is the number of sample points.

The value of the fundamental of the cosine wave stored in the cosine wave memory 5 is read out. The read out method will be described later.

For example, when the position of the sample point K is read out from the cosine wave memory 5, the value $y=\cos(K\pi/W)$ is obtained therefrom.

Then, the value of the cosine wave $\cos(K\pi/W)$ read out from the cosine wave memory 5 is applied to a multiplier 10 via a route a data switching circuit I6, the multiplier 10, a data switching circuit II7 and a latch circuit I9, as indicated by arrows. Thus, the abovesaid cosine wave value is multiplied by the output from the data switching circuit I6. This multiplication takes place in the following manner. Each sampling interval is divided into (W+1) computation intervals, if the highest harmonic order is taken as W. At time t=1, the data switching circuit I6 outputs "1", the data switching circuit II7 outputs "1", the latch circuit I9 outputs "1" and the multiplier 10 outputs "1". Next, at times from t=2 to t=W+1, the data switching circuit I6 derives therefrom the output of the cosine wave memory 5 as it is, so that the value $\cos(K\pi/W)$ is always obtained from the data switching circuit I6. The data switching circuit II7 outputs "1" at times t=1 and t=2 but derives therefrom the output of the multiplier 10 as it is after time t=3. Next, the output from the data switching circuit II7 is latched by the latch circuit I9 and multiplied by the output from the data switching circuit I6 in the multiplier 10. As a result of this, the multiplier 10 outputs 1 at time t=1, $\cos(K\pi/W)$ at time t=2, $\cos^2(K\pi/W)$ at time t=3, $\cos^3(K\pi/W)$, at time t=4, . . . and $\cos^W(K\pi/W)$ at time t=W+1.

In a coefficient multiplier 15, outputs 1, $\cos(K\pi/W)$, $\cos^2(K\pi/W)$, $\cos^3(K\pi/W)$, . . . and $\cos^W(K\pi/W)$ from the multiplier 10, thus obtained, are respectively multiplied by $A_n$ coefficients $A_0$, $A_1$, $A_2$, $A_3$, . . . and $A_W$ which are read out from an $A_n$ coefficient memory 13 in synchronism with the outputs from the multiplier 10. As a result of this, the $A_n$ coefficient multiplier 15 outputs $A_0 \cdot 1$, $A_1 \cdot [\cos(K\pi/W)]$, $A_2 \cdot [\cos^2(K\pi/W)]$, . . . and $A_W \cdot [\cos^W(K\pi/W)]$ (refer to Table 1).

These values are accumulated by an accumulator 18 from $A_0 \cdot 1$ to $A_W \cdot [\cos^W(K\pi/W)]$ to obtain $$\sum_{W=0}^{W} A_W \cos^W \frac{K\pi}{W},$$

which is the value of the sample point K. This value $$\sum_{W=0}^{W} A_W \cos^W \frac{K\pi}{W}$$

is written in the address K of a read-write composite waveshape memory I22. In a similar manner, the outputs from the accumulator 18 are written in the composite waveshape memory I22 at addresses from 1 to N(=2W) and the waveshape of one period is computed. Thus, the waveshape of one period is written in the composite waveshape memory I22 and the computation cycle is completed. The time necessary for the computation cycle is, for example, in the range of 1 to 2msec. The computation cycle is followed by the transmission cycle. The transmission cycle is formed with the circuit shown in FIGS. 3A and 3B and has the waveshape complementing function. The waveshape of one period written in the composite waveshape memory I22 is read out therefrom at high speed and transmitted to the subsequent transmission cycle.

In the transmission cycle, the waveshape read out from the composite waveshape memory I22 is written in a composite waveshape memory IIA31 for one period. This writing takes place at high speed, for example, in 1msec.

Upon completion of this writing, the composite waveshape memory IIA31 is put in its read-out state and read out at a speed Nf, which is N times the fundamental frequency f of a key switched on. The waveshape read out at the speed Nf is multiplied by 0, 1/M, 2/M, . . . M−1/M, 1 in a waveshape complementing multiplier A40 and the output therefrom gradually increases from the waveshape 0 to the same amplitude as the waveshape read out from the composite waveshape memory IIA31. Thereafter, until a stop or tablet changes to compute a new waveshape, the waveshape complementing multiplier A40 achieves multiplication by 1 and its output is connected to the next adder 50.

On the other hand, a composite waveshape memory IIB35 stores the waveshape computed in the preceding computation cycle and is read out by clocks Nf in synchronism with read-out of the composite waveshpae memory IIA31 and the outputs derived therefrom are multiplied by 1, M−1/M, M−2/M, . . . 1/M and 0 in the waveshape complementing multiplier B41. These multiplications are respectively synchronized with the coefficient 0, 1/M, 2/M, . . . M−1/M and 1 from the waveshape complementing multiplier A40. Then, the output from the waveshape complementing multiplier B41 is applied to the adder 50 and added to the output from the waveshape complementing multiplier A 40. Upon completion of the multiplications by 1, M−1/M, M−2/M, . . . 1/M and 0 in the multiplier B 41, read-out of the waveshape from the composite waveshape memory IIB35 is stopped and then the waveshape derived from the composite waveshape memory IIB31 is written by speed Nf in the composite waveshape memory IIB35 and stored therein as a waveform for the next waveshape complementing. As a result of this, in the case where the status of the stop or tablet is changed, conversion of the waveshape before the change to that after the change is achieved smoothly.

The output from the adder 50 is transmitted to the envelope load output shown in FIG. 4. In an envelope multiplier 60, the abovesaid output is added with attack, decay, sustain, release and other amplitude modulation effects by an envelope generator 63 controlled by a key detector and assignor 62 in accordance with an ON-OFF operation of a key switch 61. The output is applied to a complement converter 70 and then converted by a D-A converter 80 into an analog signal, thereafter being applied to a sound system 90.

As described above, the system of this invention comprises the waveshape computation cycle (refer to FIGS. 2A and 2B) and the waveshape transmission cycle (refer to FIGS. 3A and 3B) for the generation of musical notes.

The waveshape computation cycle starts with changing its content by a tone control of the stop or tablet (an input to a terminal S of a composite waveshape memory control circuit 21 in FIGS. 2A and 2B). The waveshape computation then takes place in the following sequence. Which will now be described concretely.

In FIGS. 2A and 2B, the fundamental of a cosine wave is sampled on the time base at N sample points and the amplitude values at the sample points are coded into digital signals, which are stored in the cosine wave memory 5. In this case, the value of the positive cosine wave is composed of, for example, 7 bits indicating the value and a sign bit "0" indicating that the value is positive. The value of the negative cosine wave is composed of, for example, 7 bits indicating the value in the form of a 2's complement and a sign bit indicating the negative.

The number N of the sample points is dependent upon the order W of the highest harmonic contained in the musical waveshape according to the sampling theorem and the number N is that $N \geqq 2W$, Accordingly, the value y(W,P) of the cosine wave at an address P in the case of the order W of the highest harmonic, that is, $$y(W,P) = \cos(P\pi/W) \ldots \quad (8)$$

$P = 0, 1, 2, 3, \ldots N-1$ (corresponding to the column "Frame" in Table 1)

Figure 5:
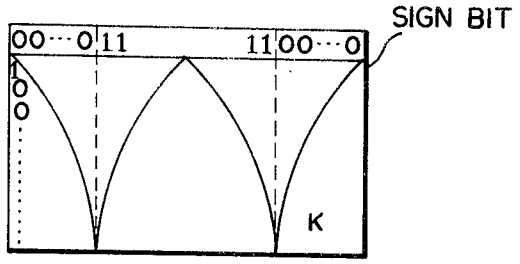
FIG. 5 shows the mode of storing of a cosine wave memory 5 in FIGS. 2A and 2B.

$N = 2W$ is stored together with a sign bit in the abovesaid manner. The status of the cosine wave memory 5 is shown in FIG. 5. In FIG. 5, there is shown the information stored in a memory such as a read only memory in which is stored a binary representation the wave shape represented by the absolute value of the cosine waves indicated by the solid line. The zeros and ones respectively designate positive and negative values of the cosine wave without using its absolute value.

The cosine wave memory 5 depicted in FIGS. 2A and 2B is read out by the cosine wave memory read counter 4 supplied with the output from the cosine wave read pulse generator which is, in turn, supplied with the output from the main clock generator 1. This read-out is achieved in synchronism with the read-out of the $A_n$ coefficient and the accumulation by the accumulator 18.

Figure 6:
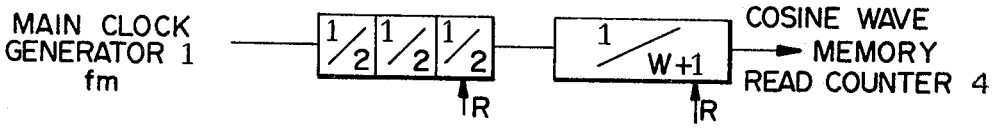
FIG. 6 illustrates one embodiment of a cosine wave read pulse generator 3 in FIGS. 2A and 2B.

As shown in FIG. 6, the cosine wave read pulse generator 3 is comprised of a $\frac{1}{8}$ frequency divider and a (W+1) frequency divider and supplied with main clock pulses $f_m$ from the high-speed main clock generator 1 (for example, 1MHz). The output of the cosine wave read pulse generator 3 is connected to the cosine wave memory read counter 4, which sequentially reads out $\cos(\pi \cdot 0/W)$, $\cos(\pi \cdot 1/W)$, $\cos(\pi \cdot 2/W)$, . . . $\cos[-(\pi \cdot K)/W]$ and $\cos[\pi \cdot (N-1)/W]$ for each frame of the fundamental of the cosine wave stored in the cosine wave memory 5.

Supplied with the output from the cosine wave memory 5, the data switching circuit I6, the multiplier 10. The data switching circuit II7, the latch circuit I9, the $A_n$ coefficient multiplier 15 and the accumulator 18 respectively outputs data and computations are carried out. The computations and their control are effected in synchronism with the high-speed clock pulse generated by the main clock generator 1. These computations and their control are achieved in the following manner.

Figure 7:
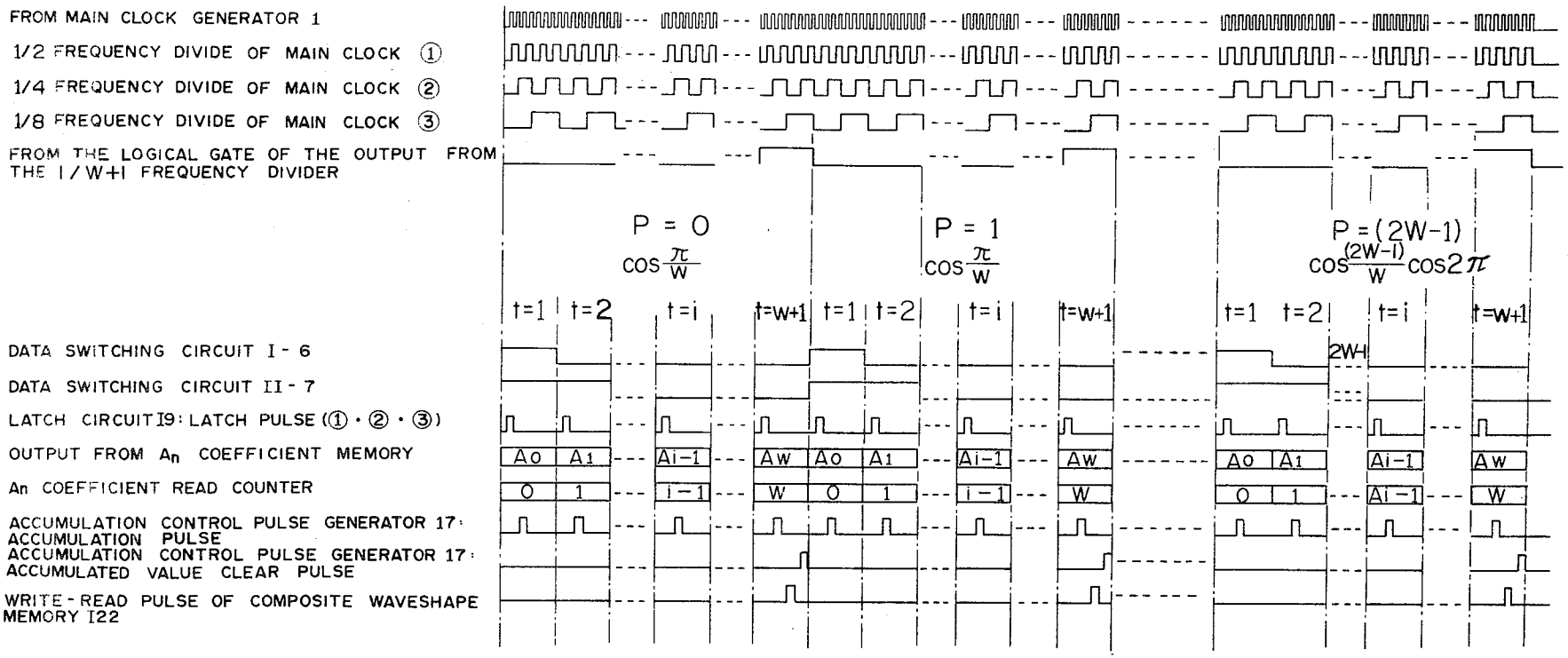
FIG. 7 is a time chart showing operations of respective parts of a waveshape computation cycle in FIGS. 2A and 2B.

Table 1 shows the outputs from the cosine wave memory, the inputs a to the multiplier 10, the inputs b to the multiplier 10, the outputs from the multiplier, the outputs from the $A_n$ coefficient memory, the outputs from the $A_n$ coefficient multiplier 15 and the contents of the accumulator 18 at respective times in each frame of the fundamental of the cosine wave. The time chart of the respective control pulses is shown in FIG. 7.

Figure 8:
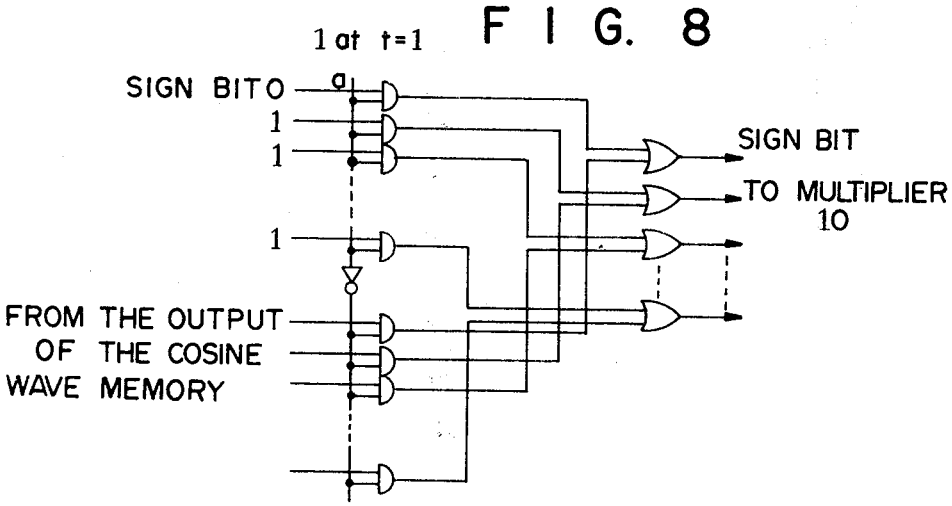
FIG. 8 illustrates one embodiment of a data switching circuit I6 in FIGS. 2A and 2B.
Figure 9:
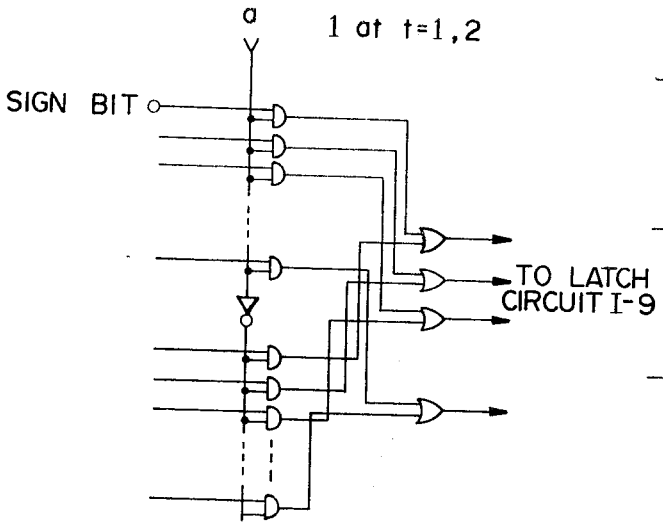
FIG. 9 illustrates one embodiment of a data switching circuit II7 in FIGS. 2A and 2B.

As illustrated in FIGS. 8 and 9, the data switching circuits I6 and II7 are identical in circuit construction with each other. At time t=1, an address of an $A_n$ coefficient read counter 12 of the $A_n$ coefficient memory 13 is "zero" and terminals a shown in FIGS. 8 and 9 are "1" so that the outputs from OR gates are all "1" except the sign bit (the leading bit). As a result of this, the data switching circuits I6 and II7 respectively output "010 . . . 0". (The leading bit represents the sign bit in the following description, too). Next, the output from the data switching circuit II7 is latched by the latch circuit I9, the output from which is multiplied by the output "0100 . . . 0" from the data switching circuit I6 in the multiplier 10. (Here, "100 . . . 0" is taken as "1".) As a result of this, "0100 . . . 0" is outputted from the multiplier 10.

At time t=2, since the terminal a in FIG. 9 is "1" as in the case of time t=1, the data switching circuit II7 outputs "0100 . . . 0" and is latched by the latch circuit I9 by a latch pulse generator 8. On the other hand, since the terminal a (in FIG. 8) is "0" at time t=2, the data switching circuit I6 derives therefrom the output $\cos(K\pi/W)$ of the cosine wave memory 5 and it is multiplied by the output "0100 . . . 0" of the latch circuit I9 in the multiplier 10. The multiplied value is applied to the next $A_n$ coefficient multiplier 15.

At time t=3, the data switching circuit I6 outputs $\cos(K\pi/W)$ as in the case of time t=2, and, since the terminal a (in FIG. 9) of the data switching circuit II7 is "0" after time t=3, the output of the multiplier, that is, $\cos(K\pi/W)$ computed previously, is provided and the latch circuit I9 latches this output, which is multiplied by the output $\cos(K\pi/W)$ of the data switching circuit I6 in the multiplier 10. As a result of this, the output of the multiplier is $\cos^2(K\pi/W)$.

At the following times t,,the same operations are carried out and, at time t=1, the data switching circuit I6 and the latch circuit I9 respectively output $\cos(K\pi W)$ and $\cos^{i-2}(K\pi/W)$ and these outputs are multiplied by each other in the multiplier 10 to produce an output $\cos^{i-1}(K\pi/W)$, where i is a symbol representing a number from zero to W.

Figure 10:
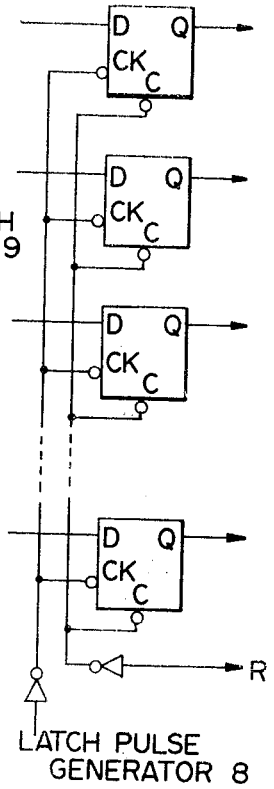
FIG. 10 shows one embodiment of a latch circuit I9 in FIGS. 2A and 2B.
Figure 11:
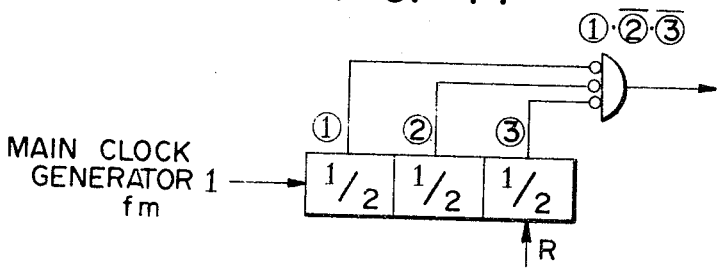
FIG. 11 shows one embodiment of a latch pulse generator 8 in FIGS. 2A and 2B.

FIG. 10 shows one concrete example of the latch circuit I9. In FIG. 10, the latch circuit I9 receives a latch pulse from the latch pulse generator 8 and latches the output from the data switching circuit II7. By applying a reset pulse to a terminal R of the latch circuit I9, the data latched in the circuit is reset. One example of the circuit construction of the latch pulse generator 8 is shown in FIG. 11. As depicted in FIG. 11, the latch pulse generator 8 receives the output $f_m$ from the main clock generator 1 and derives outputs from AND gates of outputs 1, 2 and 3 of three ½ frequency dividers. The outputs from the AND gates are applied as latch pulses to the latch circuit I9.

Figure 12:
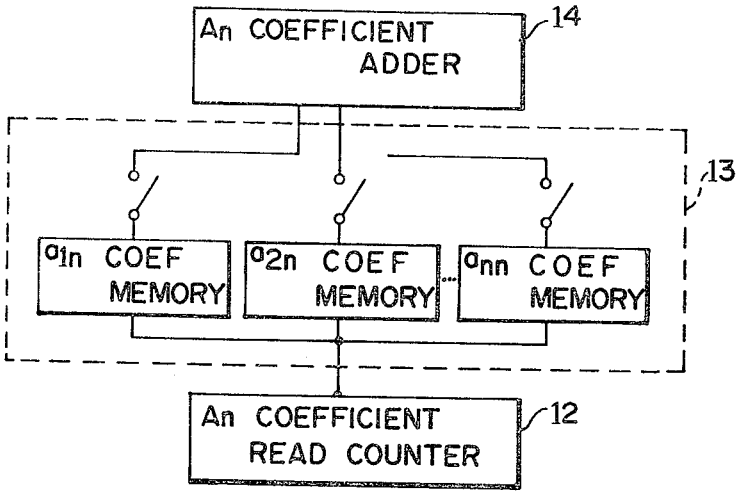
FIG. 12 illustrates one embodiment of an $A_n$ coefficient read pulse generator 11 in FIGS. 2A and 2B.

As shown in FIG. 12, the $A_n$ coefficient memory 13 (refer to FIGS. 2A and 2B) are usually composed of a plurality of memories (surrounded by the broken line) and their outputs respectively have a stop of tablet. These memories are respectively added with $A_n$ coefficients of the same orders by an $A_n$ coefficient adder (14 in FIGS. 2A, 2B and 12) and, at the same time, read out from an $A_n$ coefficients read counter 12. In this case, only those of the $A_n$ coefficient read out from the $A_n$ coefficient memories 13 whose stops or tablets are closed are added by the $A_n$ coefficient adder 14 and the following outputs $$A_0 = a_{10} + a_{20} + \ldots + a_{n0}$$

$$A_1 = A_{11} + a_{21} + \ldots + a_{n+1}$$

.

.

.

$$A_W = a_{1W} + a_{2W} + \ldots + a_{nW}$$

are derived from the $A_n$ coefficient adder 14. As will be understood by referring to Table 1, the output from the $A_n$ coefficient adder 14 is $A_0$ at time t=1, $A_1$ at time t=2, $A_2$ at time t=3, . . . $A_{i-1}$ at time t=i, . . . and $A_W$ at time t=W+1. And the output waveshape is as shown in FIG. 7.

On the other hand, the output from the multiplier 10, if the frame P is taken as K, is 1 at time t=1, $\cos(K\pi/W)$ at time t=2, $\cos^2(K\pi/W)$ at time t=3, . . . $\cos^{i-1}(K\pi/W)$ at time t=1, . . . and $\cos^W(K\pi/W)$ at time t=W+1 (refer to Table 1). These outputs are inputted to the $A_n$ coefficient multiplier 15 and respectively multiplied by $A_n$ coefficients read out in synchronism with the above times. As a result of this, the output from $A_n$ coefficient multiplier 15 is $A_0 \cdot 1$ at time t=1, $A_1 \cdot \cos(K\pi/W)$ at time t=2, $A_2 \cdot \cos^2(K\pi/W)$ at time t=3, . . . $A_{i-1} \cdot \cos^{i-1}(K\pi/W)$ at time t=1, . . . and $A_W \cdot \cos^W(K\pi/W)$ at time t=W+1.

Figure 13:
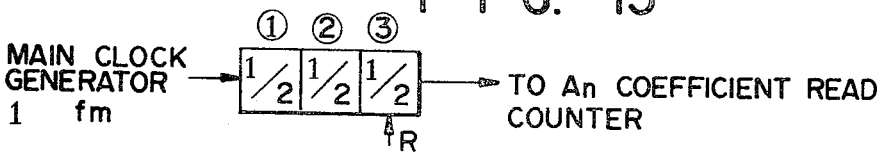
FIG. 13 illustrates one embodiment of an $A_n$ coefficient read counter 12 in FIG. 12.

The $A_n$ coefficient read pulse generator 11 and the $A_n$ coefficient read counter 12 are supplied with clock $f_m$ from the main clock generator 1 and controlled in synchronism with the main clock generator 1. FIGS. 12 and 13 respectively show embodiments of the $A_n$ coefficient read pulse generator 11 and the $A_n$ coefficient read counter 12 and their time charts are shown in FIG. 7.

In the accumulator 18, the outputs $A_0$, . . . and $A_W \cdot \cos^W(K\pi/W)$ ($A_i \cdot \cos^i(K\pi/W)$ in general formula) of the $A_n$ coefficient multiplier 15 receive accumulation pulses and accumulated value clear pulses from accumulator control pulse generator 17 and sequentially accumulated from time t=1 to t=W+1 in each frame (refer to FIGS. 2A and 2B).

Figure 14:
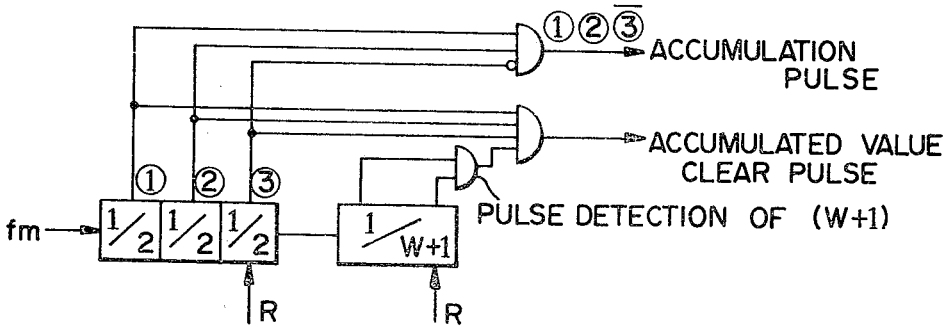
FIG. 14 shows one embodiment of an accumulating pulse generator 17 in FIGS. 2A and 2B.

One example of the circuit construction of the accumulator control pulse generator 17 is illustrated in FIG. 14. As shown in FIG. 14, the accumulator control pulse generator 17 comprises a ½ frequency divider group and a 1/W+1 frequency divider. Supplied with the main clock pulse $f_m$ from the main clock generator 1, the accumulator control pulse generator 17 derives accumulation pulses from AND gates 1, 2 and 3 forming output of the ½ frequency divider group and accumulated value clear pulses from the AND gates of the outputs of the ½ frequency divider group and the 1/W+1 frequency divider. The time charts of the accumulation pulses and the accumulated value clear pulses are shown in FIG. 7.

Figure 15:
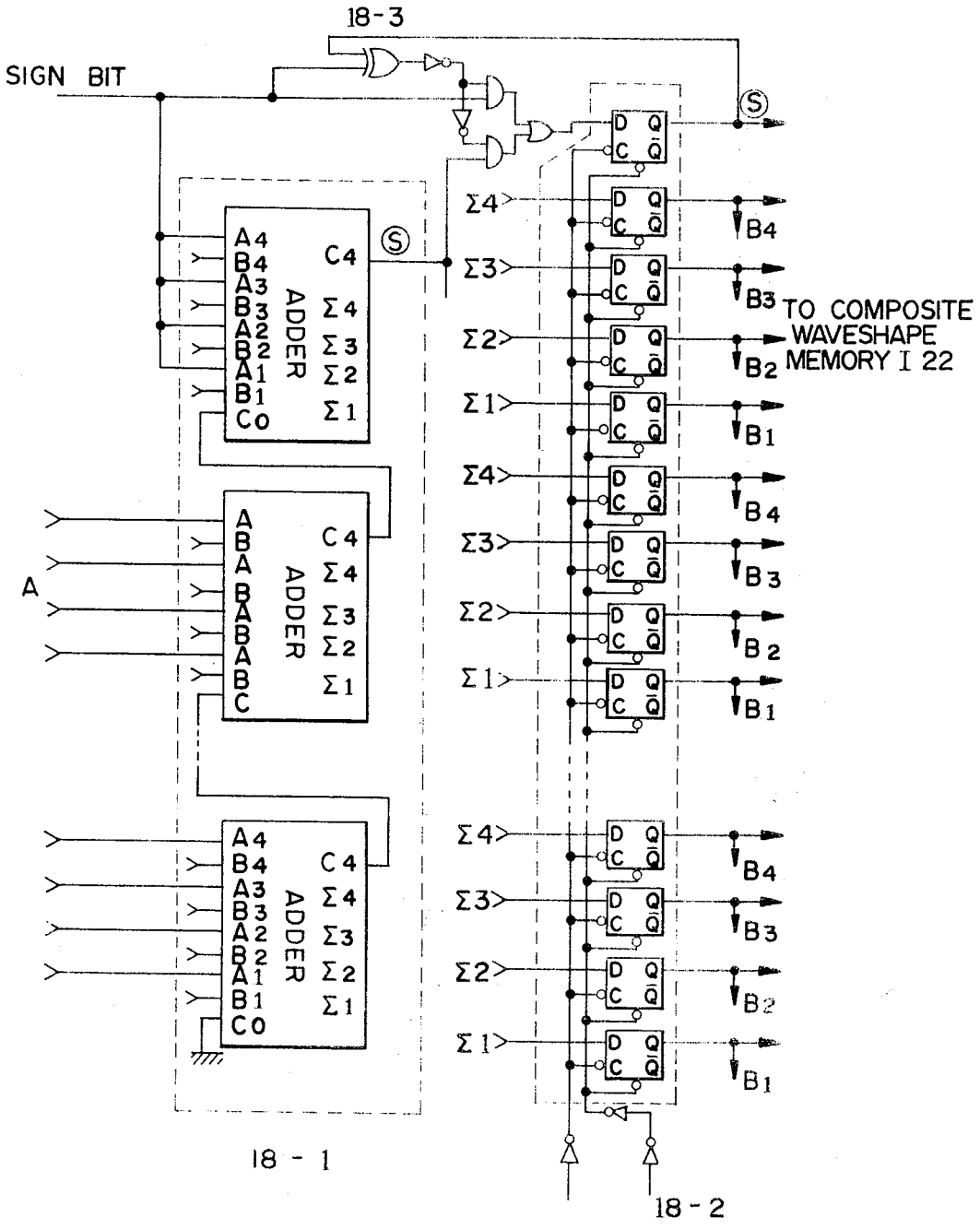
FIG. 15 shows one embodiment of an accumulator 18 in FIGS. 2A and 2B.

FIG. 15 illustrates one example of the circuit of the accumulator 18. In FIG. 15, the waveshape data inputted to the accumulator 18 from the $A_n$ coefficient multiplier 15 for accumulation, is composed of a sign bit (0 in the case of positive and 1 in the case of negative) indicating whether the value is positive or negative and actual data which is represented by a 2's complement in the case of negative. When the waveshape data from the $A_n$ coefficient multiplier 15, for example, $A_{i-1} \cdot \cos^{i-1}(K\pi/W)$, is inputted to the accumulator 18, it is transmitted to each terminal A of an adder group 18-1. On the other hand, the accumulated value $\Sigma A_{i-1} \cdot \cos^{i-1}(K\pi/W)$ obtained by preceding accumulation pulses and latched in a latch circuit 18-2 is supplied to each terminal B of the adder group 18-1. These values A and B are added by the adder 18-1 to each other and outputted therefrom. This added value A+B, i.e. $\Sigma A_{i-\lambda 1} \cdot \cos^{i-1}(K\pi/W)$ is latched by the next accumulation pulse in the latch circuit 18-2. Next, when a new waveshape data is computed and $A_i \cdot \cos^i(K\pi/W)$, is outputted from the $A_n$ coefficient multiplier 15, it is similarly added by the adder 18-1 to $A_{i-1} \cdot \cos^{i-1}(K\pi/W)$ latched in the latch circuit 18-2 to provide a new accumulated value $\Sigma A_i \cdot \cos^i(K\pi/W)$, which is latched by the accumulation pulse in the latch circuit 18-2. Thereafter, the outputs from the $A_n$ coefficient multiplier 15 are similarly accumulated up to $$\sum_{i=0}^{W} A_W \cdot \cos^W \frac{K\pi}{W}.$$

In the case where the sign bit of a newly inputted waveshape data and the sign bit latched in the latch circuit are the same, the output from the Ex-OR gate 18-3 becomes 0 and the sign bit of the newly inputted waveshape data is latched in the latch circuit 18-2.

Where the sign bits are different from each other, the output from the Ex-OR gate 18-3 becomes 1 and the most significant bit in the adder 18-1 is latched from the latch circuit 18-2. When the output from the Ex-OR gate 18-3 is 1, if the most significant bit in the adder 18-1 is 0, the added value becomes positive and, if the most significant bit is 1, the added value becomes a 2's complement.

By the accumulations from time t=1 to t=W+1 in each frame, the resulting accumulated value becomes $$\sum_{i=0}^{W} A_W \cdot \cos^W \frac{K\pi}{W}$$

and it is written in K addresses of the composite waveshape memory I22. This composite waveshape memory I22 is formed with a read-write memory. In the waveshape computation cycle, in case write-read control signal from a composite waveshape memory control circuit 21 is "1", the accumulated value $\Sigma A_W \cdot \cos^W(K\pi/W)$ of the accumulator 18 in each frame is written in the compositive waveshape memory I22 as described above (refer to FIG. 7). When the accumulated value $\Sigma A_W \cdot \cos^W(K\pi/W)$ is written in the composite waveshape memory I22, the accumulated value in the accumulator 18 is cleared by the accumulated value clear pulse from the accumulation control pulse generator 17.

Next, also in the next frame, similar accumulations are sequentially carried out from time t=1 to t=W+1 by the accumulation pulses from the accumulation control pulse generator 17 and the resulting accumulated value $$\sum_{i=0}^{W} A_W \cdot \cos^W \frac{K\pi}{W}$$

is written in K addresses of the composite waveshape memory I22.

Thereafter, similar operations are repeated, by which waveshape data is written in the composite waveshape memory I22 from an address "0" to the subsequent ones, and when the waveshape data of one period has been written in the memory, the computation cycle is completed.

Figure 16:
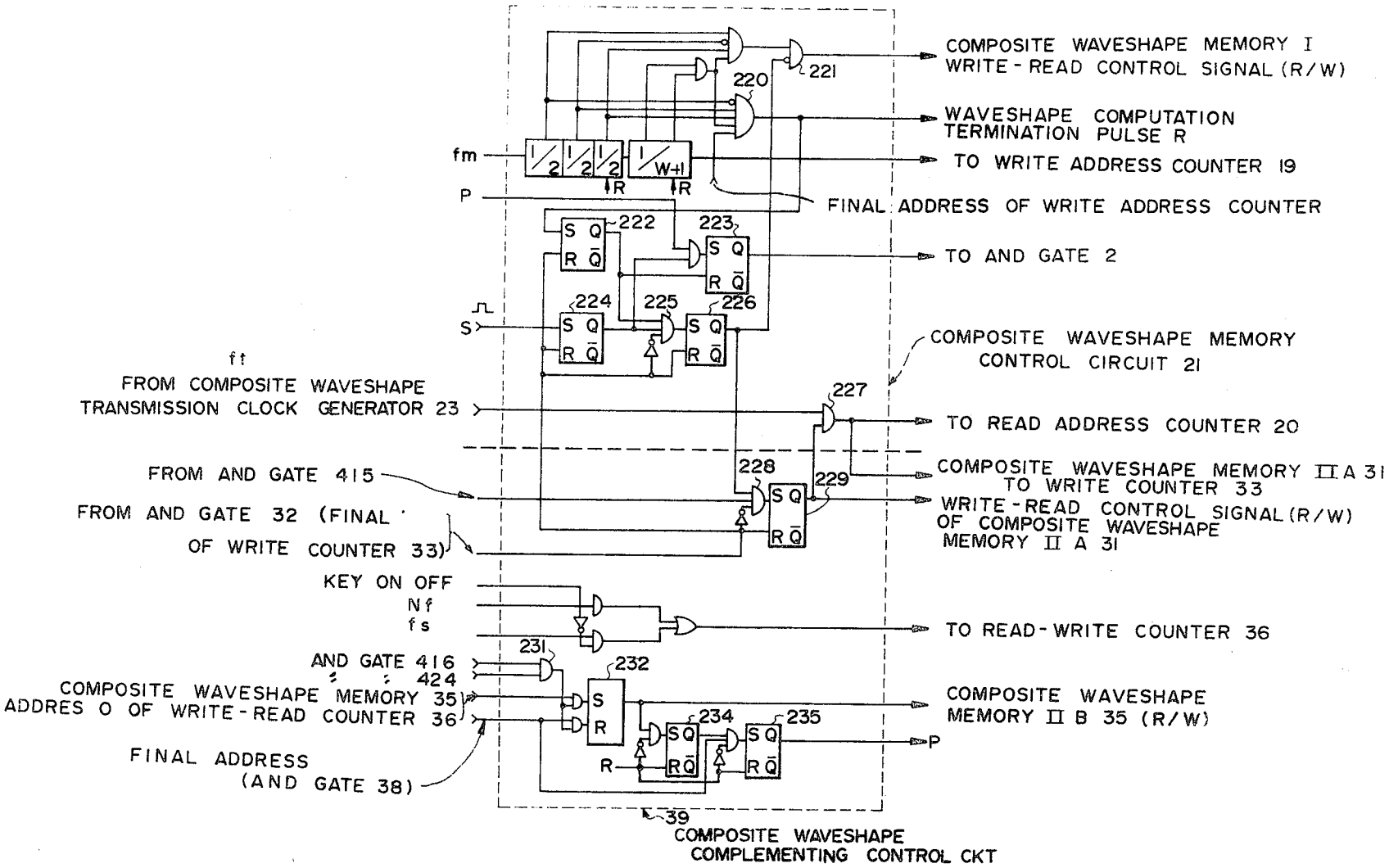
FIG. 16 shows one embodiment of each of a composite waveshape memory control circuit 21 in FIGS. 2A and 2B and a composite waveshape complementing control circuit 39 in FIGS. 3A and 3B.

FIG. 16 shows one example of the circuit in which the composite waveshape memory control circuit 21 and a composite waveshape complementing control circuit 39 are combined together, the upper broken line block indicating the former and the latter broken line block the latter. In FIG. 16, the composite waveshape memory control circuit 21 is driven by a start pulse S (a pulse when the status of the tablet or stop is changed), a clock $f_t$ from a composite waveshape transmission clock generator 23 (refer to FIGS. 2A and 2B), the clock $f_m$ from the main clock generator 1 and the output P from an R·S flip-flop 235 of the composite waveshape complementing control circuit 39, to output a write-read control signal, a write pulse, a read pulse and a waveshape computation termination pulse R.

Upon completion of the computation cycle, the composite waveshape memory control circuit 21 outputs the waveshape computation termination pulse R. This is outputted from an AND gate 220 in FIG. 16 and it is applied to reset terminals of counters of the respective pulse generators and the control circuit used in the computation cycle to reset them.

Next, a description will be given of operations by which the content of the composite waveshape memory I22 is transferred to the composite waveshape memory IIA31.

Figure 17:
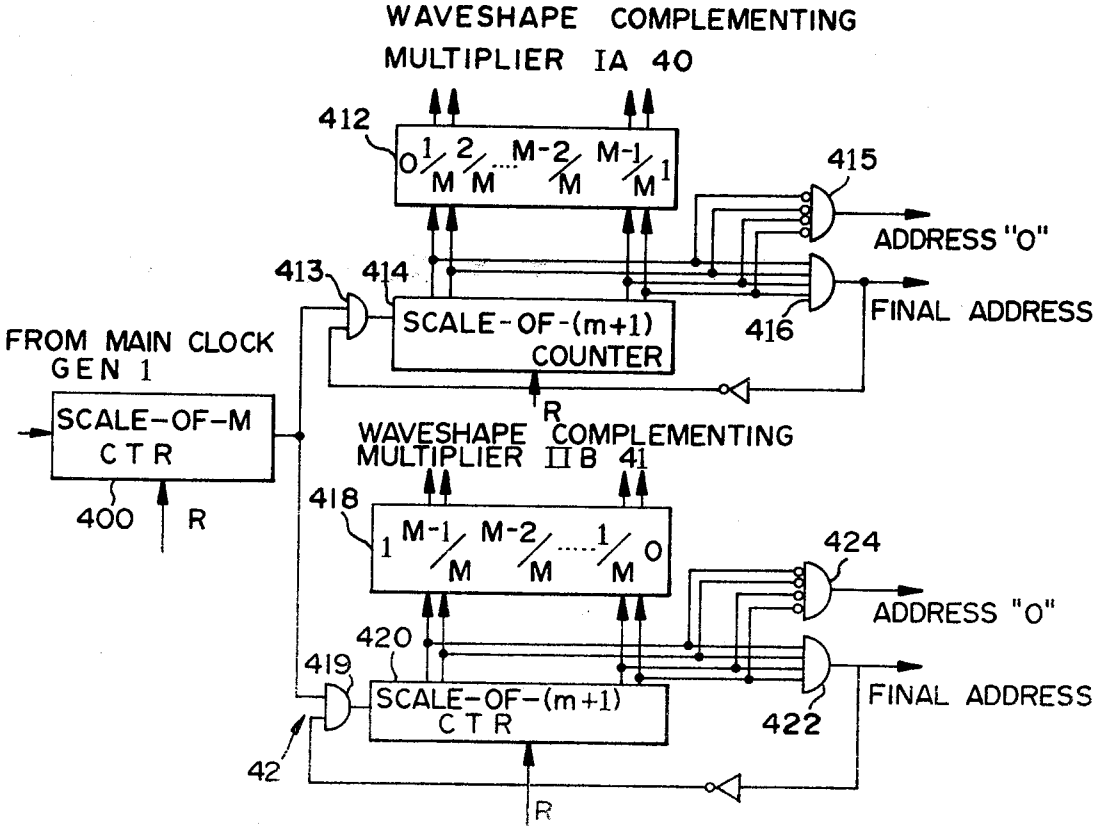
FIG. 17 shows one embodiment of each of a waveshape complementing control circuit 42 and waveshape complementing multipliers A and B (40 and 41) in FIGS. 3A and 3B.

In these operations, the circuits shown in FIGS. 16 and 17 (the waveshape complementing control circuit 42 and the waveshape complementing multipliers A and B in FIGS. 3A and 3B being indicated by 40 and 41, respectively) will play important roles.

In the composite waveshape memory control circuit 21 depicted in FIG. 16, when the respective elements are supplied with the waveshape computation termination pulse R, an R·S flip-flop 222 is set and since it is arranged so that the computation starts when the status of the tablet or stop is changed. S terminals have already been supplied with the pulse and an R·S flip-flop 224 (refer to FIG. 16) is in its set state. Further, signals applied to R terminals of the respective R·S flip-flops are "0" because the write counter (refer to FIGS. 3A and 3B) is not yet in its final address. As a result of this, the output from an AND gate 225 connected to the output of the R·S flip-flop 224 is "1" and the R·S flip-flop 226 is put in its set state. When the output from the R·S flip-flop 226 becomes "1", the AND gate 221 becomes "0" and the write-read control signal for the composite waveshape memory I22 becomes a read signal.

On the other hand, the waveshape complementing control circuit in FIG. 17 concretely shows circuit 42 and the waveshape complementing multipliers A and B (40 and 41) in FIGS. 3A and 3B. The waveshape complementing multipliers 40 and 41 respectively comprise scale-of-(m+1) counters 414 and 420 and waveshape complementing value memories 412 and 418. Their operations will be described later on.

The input to an AND gate 228 depicted in FIG. 16 is the output from an AND gate 415 (refer to FIG. 17) and the output from the scale-of-(m+1) counter 414 (refer to FIG. 17) is "0", so that the output from the AND gate 415 becomes "0" and the output from the AND gate 228 becomes "1". Consequently, an R·S flip-flop 229 is put in its set state and the clock $f_t$ from the composite waveshape transmission clock generator 23 (refer to FIGS. 2A and 2B) is applied through an AND gate 227 to a read address counter 20 of the composite waveshape memory I22. Further, a write-read control signal for the composite waveshape memory IIA31 also becomes "1" to provide a write state. At the same time, the output from the AND gate 227, that is, the composite waveshape transmission clock $f_t$, is applied to a write counter 33 of the composite waveshape memory IIA31 and a read operation of the composite waveshape memory I22 and a write operation of the composite waveshape memory IIA31 are carried out by the same composite waveshape transmission clock $f_t$, by which the content of the composite waveshape memory I22 is transferred to the composite waveshape memory IIA31. The composite waveshape memories IIA31 and IIB35 are respectively formed with read-write memories similar to the composite waveshape memory I22.

When the waveshape in the composite waveshape memory I22 has thus been written in the composite waveshape memory IIA31 for one period, the final address of the write counter 33 (refer to FIGS. 3A and 3B) and the output from an AND gate 32 becomes "1", by which the R·S flip-flop 222, 224, 226 and 229 are reset, and write of the waveshape in the composite waveshape memory IIA31 from the composite waveshape memory I22 is completed. Upon completion of the write, the composite waveshape memory IIA31 is put in its read state and read at the speed Nf corresponding to the key switched on.

However, in the waveshape complementing control circuit shown in FIG. 17, the scale-of-(m+1) counters 414 and 420 are counted by the main clock generator 1 through a scale-of-M counter 400 at the same time as the computation cycle starts. The scale-of-(m+1) counters are lower in speed than the write counter of the composite waveshape memory IIA31 and while the scale-of-(m+1) counters are in the "0" counter, write in the compoite waveshape memory IIA31 is completed. While the waveshape newly computed by the computation cycle is written and the scale-of-(m+1) counter is in the "0" count, the composite waveshape memory having stored therein the waveshape computed by the preceding computation cycle (in the case of a first computation cycle, no waveshape is stored) is put in its read state and the waveshape is read out at the speed Nf corresponding to the key switched on.

Figure 18:
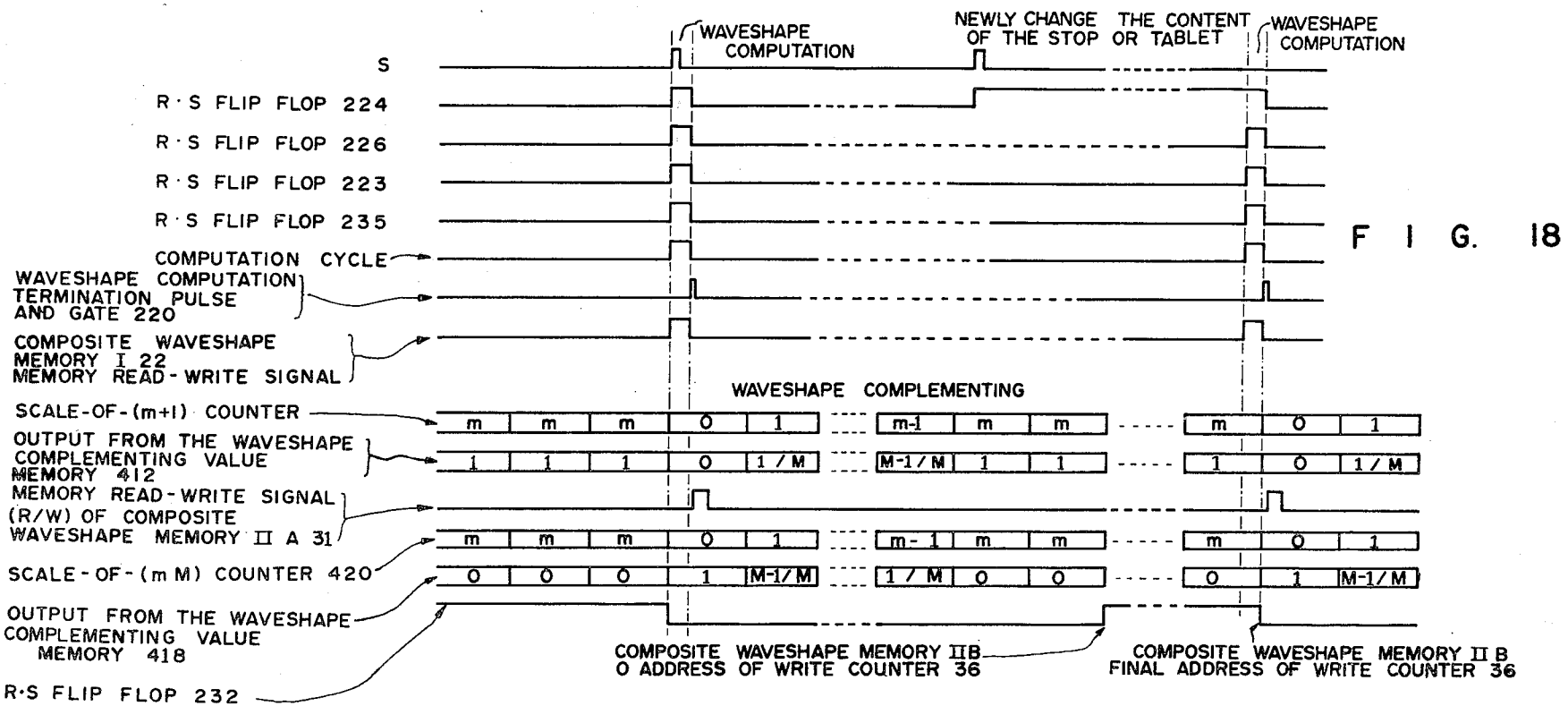
FIG. 18 is a time chart showing the operations of the computation cycle of FIGS. 2A and 2B and the transmission cycle of FIGS. 3A and 3B.
Figure 19A:
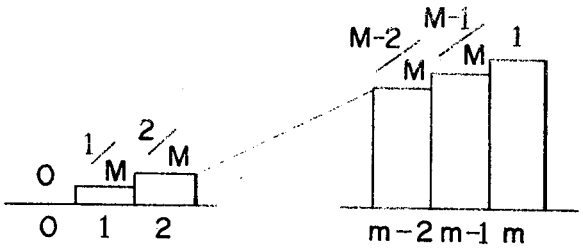
FIGS. 19A, 19B and 19C show the modes on operation for the waveshape conversion by the circuit of FIG. 17.
Figure 19B:
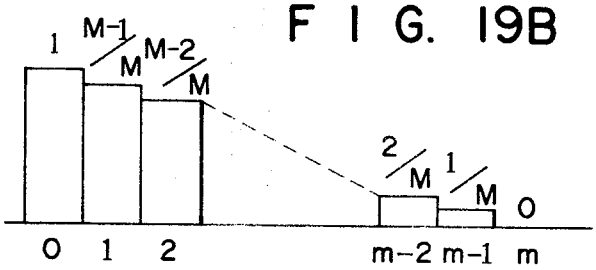
Figure 19C:
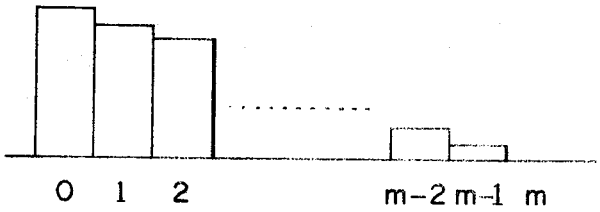

In FIGS. 3A and 3B, the outputs from the composite waveshape memories IIA31 and IIB35 are respectively applied to the next waveshape complementing multipliers 40 and 41. In the multipliers 40 and 41, the waveshapes read out from the composite waveshape memories IIA31 and IIB35 in synchronism with each other are respectively multiplied by the contents of the waveshape complementing value memories 412 and 418 (refer to FIG. 17), by which the waveshape obtained by the preceding computation cycle is smoothly replaced with the newly computed waveshape. The waveshape complementing value memory 412 shown in FIG. 17 stores such values which sequentially increase from 0 to 1. On the other hand, the waveshape complementing value memory 418 stores therein such values which sequentially decrease from 1 to 0. Accordingly, in the waveshape complementing multiplier A40, the newly computed waveshape is multiplied by the content of the waveshape complementing value memory 412 which gradually increases from 0, so that the waveshape increases as the scale-of-(m+1) counter 414 proceeds step by step. In the waveshape complementing multiplier B41, the waveshape computed by the preceding computation cycle is multiplied by the content of the waveshape complementing value memory 418 which gradually decreases from 1, so that the waveshape decreases to zero as the scale-of-(m+1) counter 420 proceeds step by step. The timing diagram of the above operation is shown in FIG. 18 and the manner of substitution of the waveshape is shown in FIGS. 19A, 19B and 19C. When the scale-of-(m+1) counters 414 and 420 proceed their counting to reach their final addresses, the outputs from AND gates 416 and 422 of the waveshape complementing control circuit depicted in FIG. 17 become "1" to close AND gates 413 and 419 through inverters, respectively, so that counting of the scale-of-(m+1) counters 414 and 420 is stopped and the waveshape complementing value memories 412 and 418 output "1" and "0", respectively.

Consequently, the output from the composite waveshape memory IIA31 is derived as it is from the waveshape complementing multiplier A40 and no output is derived from the waveshape complementing multiplier B41. Further, when the outputs from the AND gates 416 and 422 of the waveshape complementing control circuit 42 (refer to FIG. 17) are both "1", the output from an AND gate 231 shown in FIG. 16 becomes −1" and the address of the composite waveshape memory IIA31, which is read out at the speed Nf, becomes "0". And when the output from an AND gate 37 depicted in FIGS. 3A and 3B becomes "1", the output from the R·S flip-flop 232 (refer to FIG. 16) becomes "1" and the composite waveshape memory IIB35 is put in its write state and the newly computed waveshape data read out from the composite waveshape memory IIA31 is outputted to the waveshape complementing multiplier A40 and, at the same time, written in the composite waveshape memory IIB35 from an address "0" for one period. When the composite waveshape memory IIB35 reaches its final address, the output from an AND gate 38 in FIGS. 3A and 3B becomes "1" and the R·S flip-flop 232 (refer to FIG. 16) is reset, thus completing write from the composite waveshape memory IIA31 to the composite waveshape memory IIB35. Upon completing of this write the R·S flip-flop 232 is supplied with a final address signal of the read-write counter 36 of the composite waveshape memory IIB35 and the output from the R·S flip-flop 235 becomes "1". By outputting "1" from the R·S flip-flop 235 (the output P) and by changing the content of the stop or tablet, a pulse appears at the S terminal to set the R·S flip-flop 224, by which the R·S flip-flop 223 (refer to FIG. 16) is put in its set state and the clocks from the main clock generator 1 are applied through an AND gate 2 to the respective control circuits and pulse generators of the computation cycle, thus starting a new computation cycle.

No new computation cycle is started unless the content of the stop or tablet is changed and, even if changed, no new waveshape computation takes place until the R·S flip-flop 235 (refer to FIG. 16) becomes "1".

Further, as described above, in the case where the key is in its on state, read and write are carried out by the speed Nf corresponding to the key on state. Where the key is in its off state, a clock $f_s$ of a certain speed is used and the same operation as those in the case of the key being in the on state are achieved to carry out the computation cycle and the transmission cycle even while the key is in the off state. For the computation cycle, only one circuit is required regardless of the number of priority channels of the key (for example, 12 channels) but the same number of circuits as that of the channels are required for the transmission cycle.

Next, the outputs from the waveshape complementing multipliers A40 and B41 are added together by the adder 50 and the waveshape computed in the preceding computation cycle is smoothly substituted with the waveshape computed in the suceeding computation cycle.

The output from the adder 50 is applied to the envelope load output. This output is applied first to the envelope multiplier 60, to which an envelope waveform of attack, decay, sustain and release is applied from the envelope generator 63 under the control of the on-off operation of the key switch 61 through the key detect and assignor 62. In the envelope multiplier 60, the waveshape applied thereto from the adder 50 is multiplied by the abovesaid envelope waveshape.

The key detect and assignor 62 generates the clocks Nf corresponding to the key having turned on the key switch 61. The clocks Nf are applied to the composite waveshape complementing control circuit 39 and employed as read and write clocks for the composite waveshape memories IIA31 and IIB35, as described previously. Further, an on-off signal of the key is also applied together with the above clocks Nf.

The output from the envelope multiplier 60 takes the form of a complement on two with respect to a negative value, so that, in the complement converter 70 following the multiplier 60, the value in the form of the complement on two is converted into a normal value by the sign bit outputted from the envelope multiplier 60 and the resulting signal is converted by the D-A converter 80 into an analog signal, thereafter being supplied to the sound system 90.

As has been described in the foregoing, this invention is to provide an electronic musical instrument which is capable of synthesizing musical waveshape in a digital manner and hence enables synthesizing of notes of all musical instruments and can be easily assembled and manufactured by the introduction of IC, LSI techniques. The respective parts in the waveshape computation cycle, the waveshape transmission cycle and so forth described above, can be assembled by the following IC products.

| | | |
|---|---|---|
| Cosine wave memory 5 | MOS1602A | (Intel Corporation) |
| Composite waveshape memory I22 | MF1101A | |
| Composite waveshape memories 11A31, 35 | MF1101A | (Microsystems International Limited) |
| Waveshape complementing value memories 412, 418 | FIG. 17 | MOS1702 (Intel Corporation) |
| Cosine wave read pulse generator | FIG. 6 | SN74293 × 2 |
| Data switching circuit 6 | FIG. 8 | SN7408 |
| Latch circuit 9 | FIG. 10 | SN74174 |
| Latch pulse generator 8 | FIG. 11 | SN74293 |
| Accumulator control pulse generator 17 | FIG. 14 | SN74293, SN7411 SN7421 |
| Accumulator 18 | FIG. 15 | SN74283, SN74174 |
| R.S. flip-flops 226, 232, | FIG. 16 | SN7476 |

In the above list, products of the SN series are all manufactured by Texas Instrument and the parts not mentioned in the above list are all available on the market.

What is claimed is:

1. A method of electronically producing music in an electronic musical instrument having keys to select musical notes, by carrying out a waveshape computation cycle, a waveshape transmission cycle and an envelope load output cycle, wherein;

said waveshape computation cycle comprises the steps of:

coding the fundamental cosine wave corresponding to a selected key into a digital signal:

storing the digital signal in a memory;

sequentially computing the n powers of the cosine wave and the coefficients related to the harmonic components of the fundamental of the cosine wave, wherein n is a number up to the maximum harmonic order necessary to produce the musical notes;

accumulating the information computed in the form of the sum of the products of the n powers of the fundamental of the cosine wave and the coefficients to obtain a musical waveshape, and storing the musical waveshape in a composite waveshape memory;

said waveshape transmission cycle comprises the steps of:

reading out at high speed the waveshape stored in the composite waveshape memory;

writing the waveshape into another composite waveshape memory while storing a new musical waveshape, the waveshape being readout at a speed N times the fundamental frequency of a selected key, wherein N is at least twice the maximum harmonic order, and complementing the waveshapes while they are read out by gradually increasing the new musical waveshape and gradually decreasing the previous musical waveshape;

said envelope load output cycle comprising the steps of:

subjecting the readout waveshapes from the waveshape transmission cycle to amplitude modulation effects, complement conversion and digital analog conversion, and providing the waveshapes to an output sound system to produce music.

2. A method as in claim 1 and wherein said waveshape computation cycle further comprises, sampling the fundamental of the cosine wave on a time base at N sample intervals; coding amplitude information at each sample interval into digital signals and storing them into fundamental memory; storing the coefficients of the n powers of the fundamental of the cosine wave dependent upon the harmonic components of the musical waveshape into a coefficient memory; dividing each of the N sampled intervals into (W + 1) computation intervals wherein W is the maximum harmonic order; sequentially multiplying the stored information from the fundamental memory in each of the (W + 1) computation intervals to obtain the n powers of the cosine wave; sequentially multiplying the resulting outputs by the coefficients of the n powers of the cosine wave; and accumulating the products of the multiplications to form a musical note in each sample interval.

3. A method as in claim 1 wherein said waveshape computation cycle further comprises, storing into a fundamental memory the fundamental cosine wave coded into a digital signal; storing into a coefficient memory in the form of digital signals coefficients indicative of the harmonic components of the musical note in certain relationships; sequentially multiplying the cosine wave outputs from the fundamental memory to obtain the n powers of the cosine wave; multiplying the respective outputs of the first multiplication by the respective coefficients from the coefficient memory; computing the sum of the fundamental to its nth power asynchronously with the frequency of the musical note in a single computation interval; storing the results of the computed sum, and reading out the stored waveshape at a speed corresponding to the frequency of the musical note.

4. A method as in claim 1, wherein the waveshape transmission cycle further comprises, reading out the stored waveshape at a frequency asynchronous with the frequency of a musical note; storing a waveshape computed in a preceeding computation cycle and a newly computed waveshape, multiplying the waveshape computed in the preceeding computation cycle in such a manner as to gradually reduce its amplitude to zero and multiplying the newly computed waveshape in such a manner as to gradually increase its amplitude from zero, and reading out and adding together both waveshapes.

5. An electronic musical instrument for producing musical notes in response to selections of keys on a keyboard, said musical instrument comprising, waveshape computation cycle means, waveshape transmission cycle means and envelope load output means;

said waveshape computation cycle means comprising coding means for encoding the fundamental of a cosine wave corresponding to a selected key into a digital signal, memory means for storing said digital signal, computation means for sequentially forming signals representing n powers of the cosine wave and coefficients related to the harmonic components of the fundamental of the cosine wave, wherein n is a number up to the maximum harmonic order necessary to provide the musical note, accumulation means for accumulating from the computation means the sum of the products of the n powers of the fundamental of the cosine wave and said coefficients to obtain a musical waveshape, and a first composite waveshape memory means for storing the musical waveshape obtained;

said waveshape transmission cycle means comprising readout means for reading out at a high speed the stored musical waveshape from said first composite waveshape memory means, a second composite waveshape memory means, the information readout from said first composite waveshape memory means being written into said second composite waveshape memory means while a new musical waveshape is stored into said first composite waveshape memory means, said readout occurring at a speed of N times the fundamental frequency of a selected key, wherein N is at least twice the maximum harmonic order, and complementing means for gradually increasing the new musical waveshape from the first composite waveshape memory means and gradually decreasing the waveshape from the second composite waveshape memory means at the same time as the waveshapes are read out from said first and second composite waveshape memory means; and said envelope load output means comprising modulation means receiving the complemented waveshapes read out from said waveshape transmission cycle means for providing amplitude modulator effects to said readout waveshape, conversion means for subjecting said modulated waveshape to complement conversion and digital to analog conversion, and output means for providing said waveshape to a sound system to produce the musical notes.

6. An electronic musical instrument as in claim 5 wherein said waveshape computation cycle means further comprises sampling means for sampling the fundamental of the cosine wave on a time base at N sample intervals, said coding means encoding amplitude information into a digital signal at each sampled interval, said memory means including a fundamental memory for storing said encoded amplitude information and a coefficient memory for storing coefficients of the n powers of the fundamental of the cosine wave dependent upon the harmonic components of the musical waveshape, dividing means for dividing each of the N sampled intervals into (w + 1) computation intervals, wherein W is the maximum harmonic order, first multiplication means for sequentially multiplying the stored information from the fundamental memory to obtain n powers of the cosine wave; second multiplication means for sequentially multiplying the resulting outputs of said first multiplication means by the coefficients of the n powers of the cosine wave, the products obtained being accumulated in said accumulation means for each sampled interval to from a musical note.

7. An electronic musical instrument as in claim 5 wherein the waveshape computation cycle means further comprises a fundamental memory for storing the fundamental of the cosine wave coded into a digital signal, a coefficient memory for storing in the form of digital signals coefficients indicative of the harmonic components of the musical note in certain relationships, a first multiplier circuit for sequentially multiplying the cosine wave outputs from the fundamental memory to obtain the n powers of the cosine wave, a second multiplier circuit for multiplying the respective outputs of the first multiplier circuit by the respective coefficients from the coefficient memory, said first composite waveshape memory computing the sum of the fundamental to its nth power asynchronously with the frequency of the musical note in a single computation interval and storing the result of the computation, the content of the first composite waveshape memory being read out at a speed corresponding to the frequency of the musical note.

8. An electronic musical instrument as in claim 5 wherein the content of the first composite waveshape memory is read out at a frequency asynchronous with the frequency of a musical note, and wherein said waveshape transmission cycle means stores the waveshape computed in the preceding computation cycle and the newly computed waveshape, said complementing means includes means for multiplying the waveshape computed in the preceding computation cycle in a manner to gradually reduce its amplitude to zero and for multiplying the newly computed waveshape in a manner to gradually increase its amplitude from zero, and for adding together both said waveshapes.

* * * * *